US007069864B2

(12) United States Patent
Gray

(10) Patent No.: US 7,069,864 B2
(45) Date of Patent: Jul. 4, 2006

(54) RAILWAY FREIGHT CAR END SILL TRANSITION MEMBER

(75) Inventor: James A. Gray, St. Louis, MO (US)

(73) Assignee: ASF-Keystone, Inc., Granite City, IL (US)

( * ) Notice: Subject to any disclaimer, the term of this patent is extended or adjusted under 35 U.S.C. 154(b) by 59 days.

(21) Appl. No.: 10/888,847

(22) Filed: Jul. 12, 2004

(65) Prior Publication Data

US 2006/0005740 A1 Jan. 12, 2006

(51) Int. Cl.
*B61D 17/00* (2006.01)

(52) U.S. Cl. ..... 105/420; 105/416; 105/421

(58) Field of Classification Search ..... 105/413, 105/416, 420, 421, 415; 213/51
See application file for complete search history.

(56) References Cited

U.S. PATENT DOCUMENTS 3,973,681 A * 8/1976 Martin et al. ..... 213/8
5,762,003 A * 6/1998 Downes et al. ..... 105/416
6,398,047 B1 6/2002 Ladendorf et al.

* cited by examiner

*Primary Examiner*—Mark T. Le
(74) *Attorney, Agent, or Firm*—Edward J. Brosius

(57) ABSTRACT

A transition member for use in a railway freight car is provided. The transition member provides connection between the dissimilar cross sections of the underbody and draft sill of the railway freight car and the center sill of the railway freight car. The transition member is usually a unitary cast steel structure and is of a generally rectangular or square cross section.

11 Claims, 3 Drawing Sheets

RAILWAY FREIGHT CAR END SILL TRANSITION MEMBER

BACKGROUND OF THE INVENTION

The present invention relates to railway freight car draft sills and center sills and, more particularly, to a transition member for use in connecting between the dissimilar cross sections of a draft sill and a center sill of a railway freight car.

The prevalent construction of railway freight cars includes the use of two truck assemblies at either end of each car body. Each truck assembly is comprised of two sideframes that are spaced laterally and are parallel with the railway tracks. A bolster extends laterally between the two sideframes to form what is commonly referred to as a three piece railway freight car truck.

The railway freight car body itself includes a center sill structure which extends longitudinally the virtual entire length of the freight car to provide the main support member for the railway freight car. Ends of the center sill include draft sills, which can be fabricated or cast. Such draft sills include a center plate for connection to a center bowl structure located on the truck bolster. Further, an end sill is connected to the railway freight car body in alignment with the center sill, but near each end of the railway freight car. The end sill is designed to receive a coupler assembly.

It is desirable to provide a connection between the dissimilar cross sections of a draft sill and the end sill that is adaptable to the various designs of railway freight cars.

Accordingly, it is an object of the present invention to provide an improved transition member for use in connection between the draft sill and end sill of a railway freight car.

SUMMARY OF THE INVENTION

The present invention relates to a railway freight car that includes an underframe assembly comprising a draft sill and an end sill. The end sill is associated and receives the various components of the coupler assembly. It is desirable to provide a transition connection between the draft sill and end sill that accommodates various designs and structures of the railway freight car. Accordingly, the present invention in particular relates to a transition member that connects between the dissimilar cross sections of a draft sill structure of the railway freight car and the end sill.

The transition member of the present invention is usually a unitary cast steel structure that is generally rectangular in cross section. The transition member can be of varying lengths, but the transition member of the present invention is of a length that is greater than its height or its width. The transition member of the present invention includes structural features that provides strength, durability, and adaptability in the railway freight car to allow connection between various locations of the draft sill and the end sill.

BRIEF DESCRIPTION OF THE DRAWINGS

Referring now to the drawings.

DETAILED DESCRIPTION OF THE INVENTION

Figure 1:
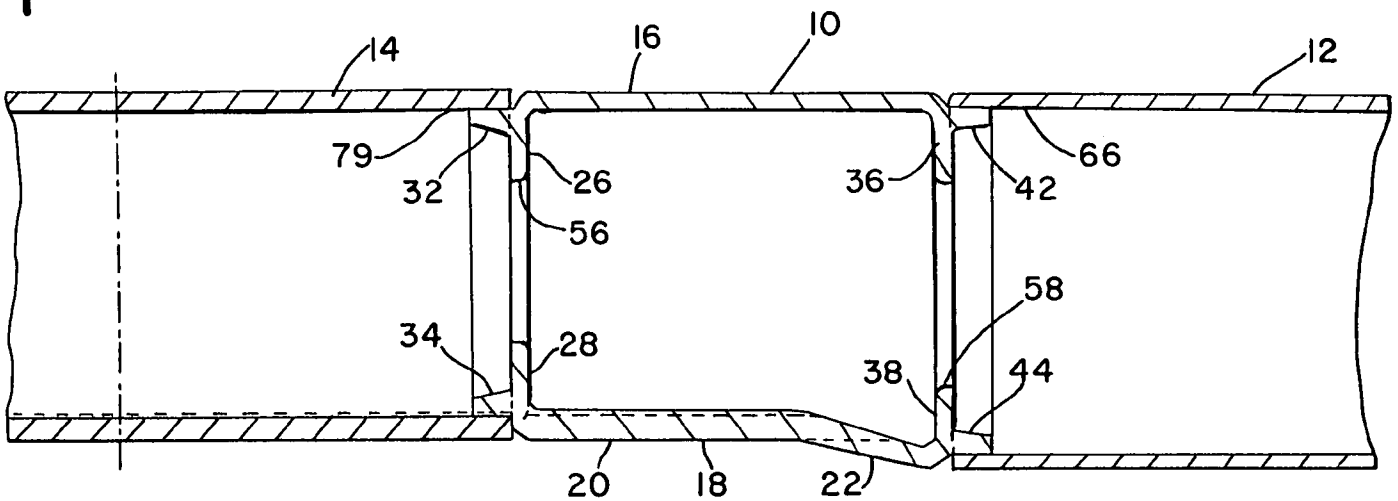
FIG. 1 is a side view, in partial cross section, of a transition member in accordance with the present invention connected between a draft sill and an end sill.
Figure 2:
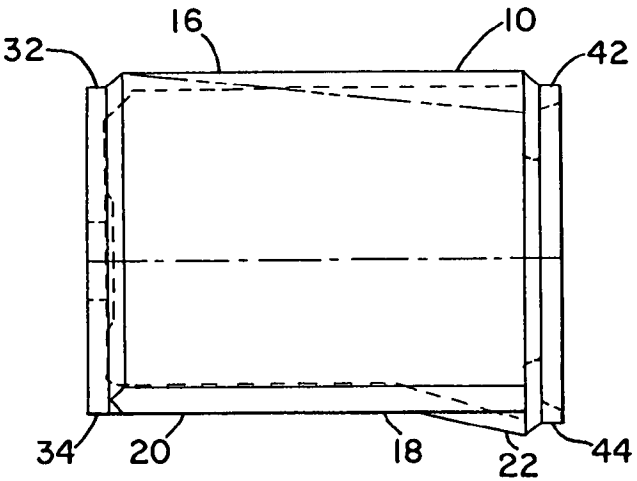
FIG. 2 is a side view of the transition member in accordance with the present invention.
Figure 3:
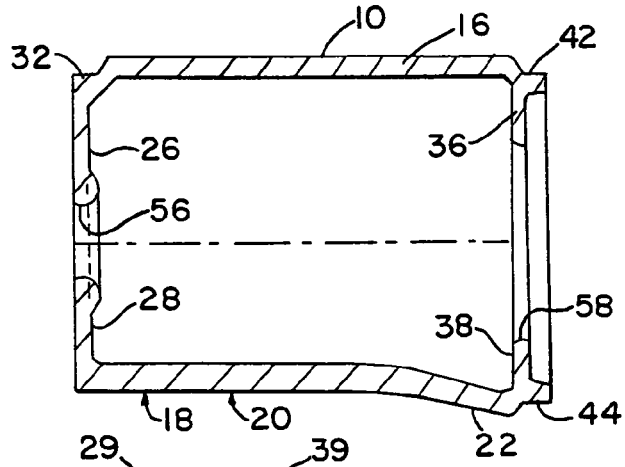
FIG. 3 is a side view, in cross section, of the transition member in accordance with the present invention.
Figure 4:
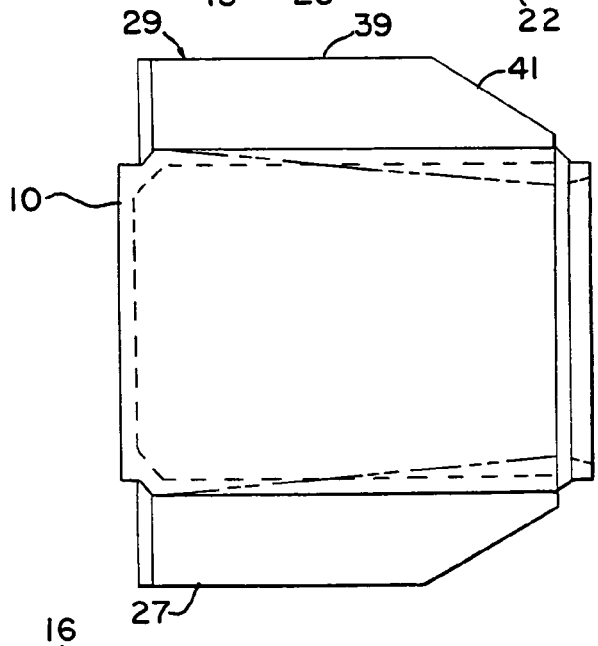
FIG. 4 is a partial bottom view of the transition member in accordance with the present invention.
Figure 5:
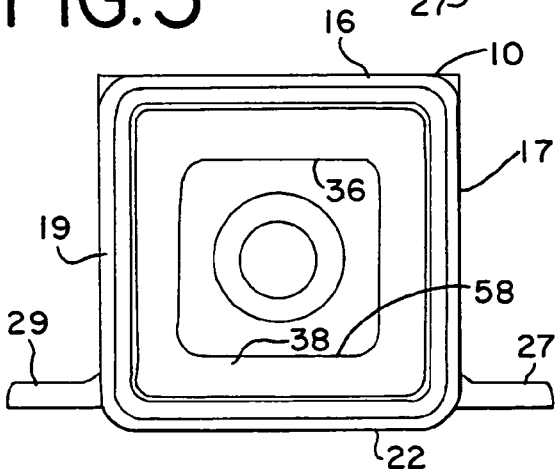
FIG. 5 is an end view of the second end of the transition member in accordance with the present invention.
Figure 6:
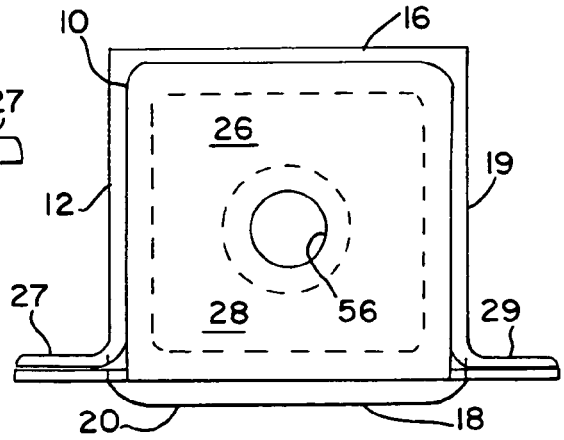
FIG. 6 is an end view of the first end of the transition member in accordance with the present invention.

Referring now to FIG. 1 of the drawings, transition member 10 in accordance with the present invention is shown generally at 10. Transition member 10 is seen to be comprised of a generally rectangular in cross section, elongated structure. Such transition member 10 is usually comprised of an integral cast steel device. Transition member 10 is seen to be comprised of top section 16, which is generally of rectangular configuration. Bottom section 18 itself is seen to be comprised of a main part 20 and a distal part 22 extending downwardly toward what is deemed the second end of transition member 10. It is seen that the second end of transition member 10 intersects with end sill 12. Also part of the second end of transition member 10 are second end top section support rib 36 which is seen to extend downwardly from top section 16, and second end bottom section support rib 38 which is seen to extend upwardly along the lateral width of the end of distal part 22. Also extending outwardly from the intersection of top section 16 and support rib 36 is a second end tapered projection 42. Tapered projection 42 is seen to be located downward below top section 16. Similarly, extending outwardly from the intersection of bottom section distal part 22 and bottom section support rib 38 is bottom section second end tapered protrusion 44. Tapered protrusion 44 is seen to be located upwardly from the very bottom edge of distal part 22.

At the first end of transition member 10, where connection is made to draft sill 14, top section support rib 26 extends downwardly from top section 16 and extends across the width of transition member 10. Similarly, bottom section support rib 28 extends upwardly from the bottom section 18 of transition member 10 and extends across the width of transition member 10. Tapered protrusion 32 extends outwardly from support rib 26 and extends across the width of transition member 10. It is also seen that tapered protrusion 32 extends from a height below that of the top of top section 16. Similarly, bottom section tapered protrusion 34 extends outwardly from bottom section support rib 28, and extends across the width of transition member 10. Tapered protrusion 34 is seen to extend outwardly from a height above that of the bottom of bottom section 18.

Bottom section 18 is seen to be comprised of a generally rectangular main part 20 of a thickness greater than that of top section 16. Further, bottom section distal part 22 is seen to be again a generally rectangular section but extending downwardly from the level of bottom section 18 to intersect with bottom section support rib 38. Further, it is seen that the thickness of distal part 22 decreases as distal part 22 extends to join bottom section support rib 38.

Referring now to FIGS. 2–6 of the drawings, detailed views of transition member 10 are provided. Transition member 10 is seen to be comprised of top section 16, bottom section 18, and wall sections 17 and 19. As described above with reference to FIG. 1, transition member 10 is seen to be of a generally rectangular or square cross section and of an elongated nature such that the length of transition member 10 is seen to exceed both its height and width.

Transition member 10 is seen to comprise bottom section wing section 27 extending outwardly beyond wall section 17, and bottom section wing section 29 extending outwardly beyond wall section 19. Wing section 29 is seen to be comprised of a generally rectangular main section 39 that extends longitudinally from the first end of transition member 10 toward the second end, but wing section 29 is also seen to comprise angled section 41 which is contiguous with main section 39 but extends inwardly at an acute angle from main section 39 to intersect with the second end of transition member 10. Bottom section wing section 27 also comprises a similar main section and an angled section.

Transition member first end top section support rib 26 and transition member first end bottom section support rib 28 are seen to extend such that a circular opening is formed therein. It is also seen that top section support rib 26 and bottom section support rib 28 extend and engage both of wall section 17 and 19. Circular opening 56 is seen to be formed by top section support rib 26 and bottom section support rib 28. Similarly, second end top section support rib 36 extends laterally to engage both of wall sections 17 and 19, and second end bottom section support rib 38 extends similarly to engage both wall sections 17 19. It is seen that second end top section support rib 36 and second end bottom section support rib 38 combine to form a generally rectangular opening 58 at the second end of transition member 10.

Figure 7:
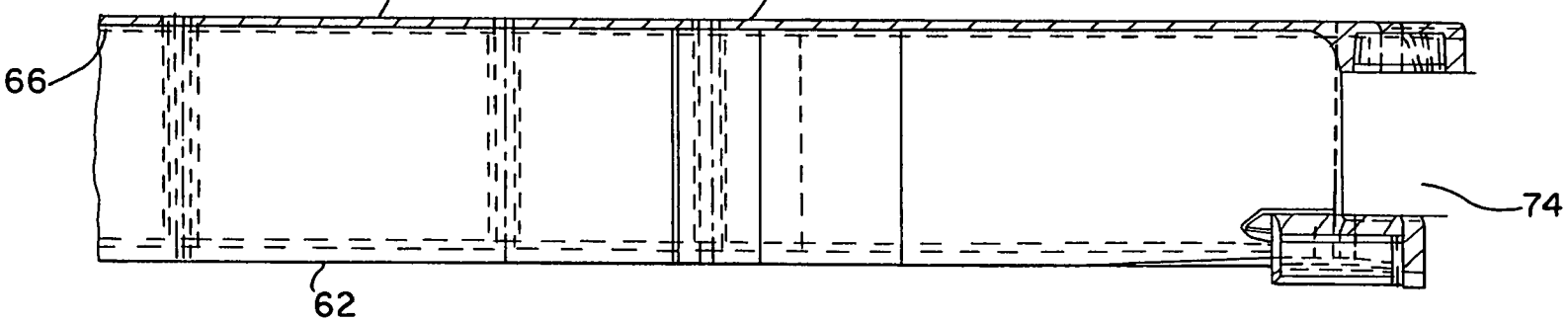
FIG. 7 is a side view, in cross section, of an end sill of a railway freight car.

Referring now to FIG. 7, a side view of end sill is shown generally at 12. End sill 12 is seen to be comprised of a top section 64, and a bottom section 62, which are generally rectangular in nature yet elongated such that the length of end sill 12 is much greater than its height or width. Further, end sill 12 is comprised of side walls that join top wall 64 and bottom wall 62. An opening 74 is located at the second end of end sill 12 to accommodate a coupler yoke and shank. Opening 66 is shown at the first end of end sill 12. It is shown in FIG. 1 that the second end of transition member 10 is received into the first end 66 of end sill 12. End sill 12 can be a fabricated structure or it can be a unitary cast structure.

Figure 8:
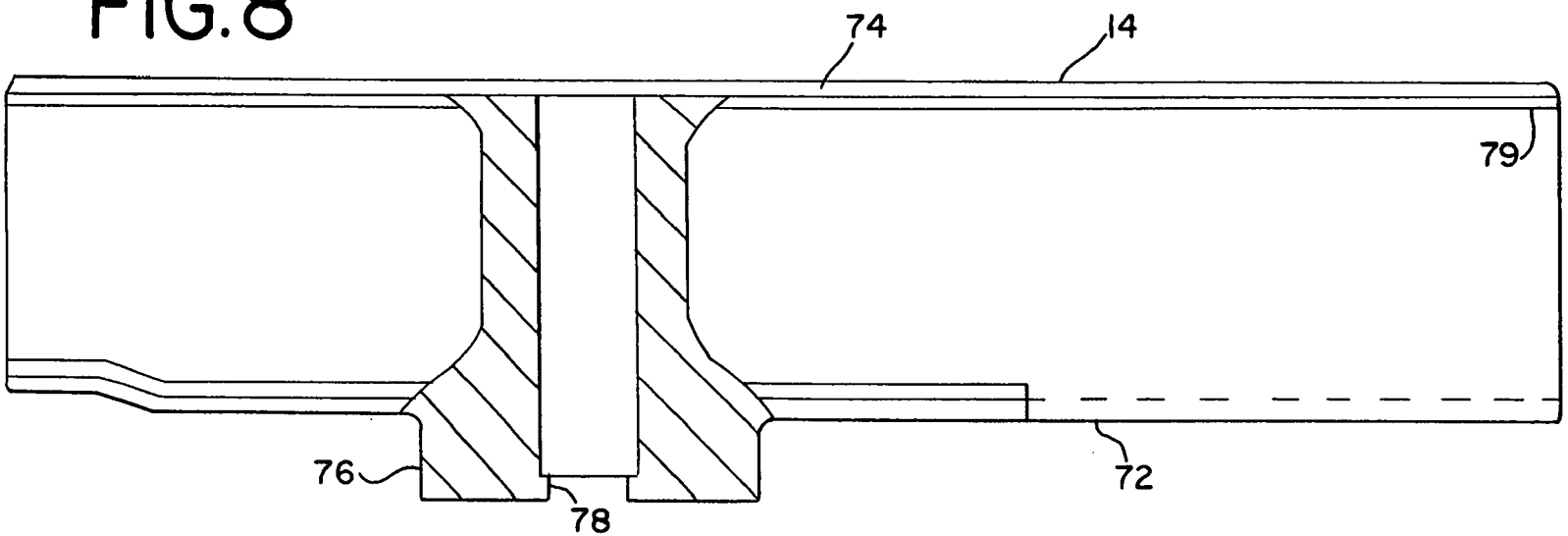
FIG. 8 is a side view, in partial cross section, of a draft sill of a railway freight car.

Referring now to FIG. 8, a draft sill is shown generally at 14. Draft sill 14 is seen to be comprised of a bottom section 72 and a top section 74, joined by two laterally spaced walls. Draft sill 14 is seen to be of a generally rectangular configuration, but of a length much greater than its height or width. Bottom section 72 of draft sill 14 is seen to also comprise a center plate 76, with a centrally located opening 78. Center plate 76 is usually of a circular configuration, as is opening 78. Such center plate 76 is received in a complementary circular opening in the top surface of the railway freight car truck bolster. Draft sill 14 is seen to be comprised of a first end 79, of a generally rectangular or square configuration. First end 79 of draft sill 14 is seen to be fit around first end tapered protrusions 32 and 34. It is usually desired that such fit is completed by welding.

What is claimed is:

1. A transition member for use in a railway freight car, the railway freight car comprising a truck assembly, an underframe assembly and a center sill, the underframe assembly includes a draft sill that provides connection between the underframe assembly and the truck assembly, an end sill, wherein the transition member connects between the end sill and the draft sill, the transition member comprising a generally rectangular in cross section elongated structure, including a top section, bottom section and two spaced wall sections that extend between the top section and the bottom section, wherein the transition member includes a first end and a second end, the first end is comprised of first edges of the top section, main part of the bottom section and two wall sections, and the second end is comprised of second edges of the top section, tapered part of the bottom section and the two wall sections, wherein the first end is received in an opening in the center sill and the second end is received in an opening in the draft sill, further comprising a second support rib structure extending inwardly from each of the top section, bottom section and the two wall sections to form a continuous support rib at the second end of the transition member, wherein the top section, bottom section and two wall sections each include a tapered protrusion that extends outwardly beyond the second support rib structure at the second end of the transition member.

2. The transition member of claim 1 wherein the bottom section of the transition member has a thickness and the top section of the transition member has a thickness, and the thickness of most of the length of the bottom section exceeds the thickness of the top section.

3. The transition member of claim 1 wherein the bottom section is comprised of a main part and a distal part, the main part of the bottom section being generally parallel with the top section, and the distal part of the bottom section extending downwardly at an acute angle from the main part.

4. The transition member of claim 1 wherein the transition member is a unitary steel casting of a generally square shape in cross section.

5. The transition member of claim 1 wherein the bottom section includes two wing sections, each wing section extending outwardly beyond the wall section.

6. The transition member of claim 5 wherein each wing section includes a main section that extends for a length about equal to the length of the main part of the bottom section and an angled section that extends for a length about equal to the length of the distal part of the bottom section.

7. The transition member of claim 6 wherein the angled section of each wing section extends at an acute angle from the main section of the wing section to the wall section of the transition member.

8. The transition member of claim 3 wherein the distal part of the bottom section is of a tapering thickness.

9. The transition member of claim 1 wherein the transition member is comprised of a unitary cast steel structure.

10. The transition member of claim 1 further comprising a first support rib structure extending inwardly from each of the top section, bottom section and two wall sections to form a continuous support rib structure at the first end of the transition member.

11. The transition member of claim 1 wherein the top section and the two wall sections are tapered inwardly at the first end.

* * * * *